US006260963B1

(12) United States Patent
Reistad et al.

(10) Patent No.: US 6,260,963 B1
(45) Date of Patent: Jul. 17, 2001

(54) INK JET PRINT HEAD WITH DAMPING FEATURE

(75) Inventors: Brett W. Reistad; Ronald F. Burr; Terrance L. Stephens, all of Wilsonville, OR (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/232,267

(22) Filed: Jan. 15, 1999

(51) Int. Cl.[7] ..... B41J 2/17
(52) U.S. Cl. ..... 347/94
(58) Field of Search ..... 347/94, 40, 63, 347/71, 70

(56) References Cited

U.S. PATENT DOCUMENTS 4,730,197 3/1988 Raman et al. ..... 347/40
5,170,177 12/1992 Stanley et al. ..... 347/11
5,625,393 * 4/1997 Asai ..... 347/69
5,736,993 4/1998 Regimbal et al. ..... 347/11
5,781,212 7/1998 Burr et al. ..... 347/84
5,963,234 * 10/1999 Miyazawa et al. ..... 347/70

* cited by examiner

*Primary Examiner*—N. Le
*Assistant Examiner*—Michael Ngiem
(74) *Attorney, Agent, or Firm*—Charles F. Moore

(57) ABSTRACT

An ink jet print head includes one or more vibration disruption chambers for reducing mechanical vibrations within the print head. The chambers are vertically spaced from ink manifolds to dissipate energy within the print head and alter the bending modes of the print head jet stack. The chambers may contain a discontinuous material that enhances their damping effects.

17 Claims, 5 Drawing Sheets

INK JET PRINT HEAD WITH DAMPING FEATURE

CROSS-REFERENCE TO RELATED APPLICATIONS

Not applicable.

STATEMENT REGARDING FEDERALLY SPONSORED RESEARCH OR DEVELOPMENT

Not applicable.

FIELD OF THE INVENTION

This invention relates generally to an ink jet print head and, more specifically, to an ink jet print head that reduces deleterious print head vibration.

BACKGROUND OF THE INVENTION

A typical color ink jet print head includes an array of ink jets that are closely spaced from one another for use in ejecting drops of ink toward a receiving surface. The typical print head also has at least four ink manifolds for receiving the black, cyan, magenta and yellow ink used in monochrome plus subtractive color printing. The number of such manifolds may be varied where a printer is designed to print solely in black ink, gray scale or with less than a full range of color.

In a conventional ink jet print head, each ink jet is paired with an electromechanical transducer, such as a piezoelectric transducer (PZT). The transducer is bonded to the flexible diaphragm and typically has metal film layers to which an electronic transducer driver is electrically connected. When a voltage is applied across the metal film layers of the transducer, the transducer attempts to change its dimensions. Because it is rigidly attached to a flexible diaphragm, the transducer bends and deforms the diaphragm, thereby causing the outward flow of ink through the ink jet.

It has been discovered that firing multiple transducers simultaneously at particular frequencies can create a global mechanical vibration mode in the print head. For example, where the ink jet nozzles are arrayed horizontally in an extended rectangular formation across the print head (see FIG. 5), firing multiple transducers at a particular frequency cam create a vertical vibration mode and bending about a horizontal axis A of the print head. A given print head may also have one or more resonance modes that correspond to a particular frequency or firing rate of the transducers/ink jets. As more transducers are actuated simultaneously at a resonant frequency, the magnitude of the mechanical vibration within the print head increases. This vibration may cause jets to become less efficient and slower in operating, especially in certain regions of the print head that are more sensitive to vibration. This reduction in jet efficiency can lead to ink drop position errors on the receiving surface and visible image artifacts, such as banding.

U.S. Pat. No. 5,781,212 to Burr et al. discloses a print head structure that controls acoustic or fluidic pressure waves in the ink flow passageways by utilizing a baffle structure to dampen the pressure waves within the passageways. U.S. Pat. No. 4,730,197 to Raman et al. teaches the use of compliance relief slots adjacent to a portion of a compliance plate that forms the bottoms of ink manifolds. The slots allow the compliance plate to flex in response to ink pressure changes and fluidic pressure waves in the manifolds. Neither of these print head structures addresses the problem of global mechanical vibrations created by simultaneously firing multiple ink jets.

Accordingly, a need exists for an improved ink jet print head that dampens global mechanical vibrations created by simultaneously firing multiple ink jets.

BRIEF SUMMARY OF THE INVENTION

It is an aspect of the present invention to provide a print head structure that dampens mechanical vibrations created by firing multiple ink jets within the print head.

It is a feature of the present invention to provide a print head structure that includes at least one vibration disruption chamber vertically spaced from an ink manifold.

It is another feature of the present invention that the vibration disruption chamber is positioned near regions in the print head that are susceptible to vibration.

It is yet another feature of the present invention that multiple, separate vibration disruption chambers may be utilized in the print head.

It is still another feature of the present invention that the dimensions and positioning of the vibration disruption chambers may be varied to control a particular resonance mode in a given print head.

It is an advantage of the present invention that the vibration disruption chambers dissipate energy within the print head.

It is another advantage of the present invention that the vibration disruption chambers allow the print head structure to operate at resonant frequencies.

Still other aspects of the present invention will become apparent to those skilled in this art from the following description, wherein there is shown and described a preferred embodiment of this invention by way of illustration of one of the modes best suited to carry out the invention. The invention is capable of other different embodiments and its details are capable of modifications in various, obvious aspects all without departing from the invention. Accordingly, the drawings and descriptions will be regarded as illustrative in nature and not as restrictive. And now for a brief description of the drawings.

Reference will now be made in detail to the present preferred embodiment of the invention, an example of which is illustrated in the accompanying drawings.

DETAILED DESCRIPTION OF THE PREFERRED EMBODIMENT

Figure 1:
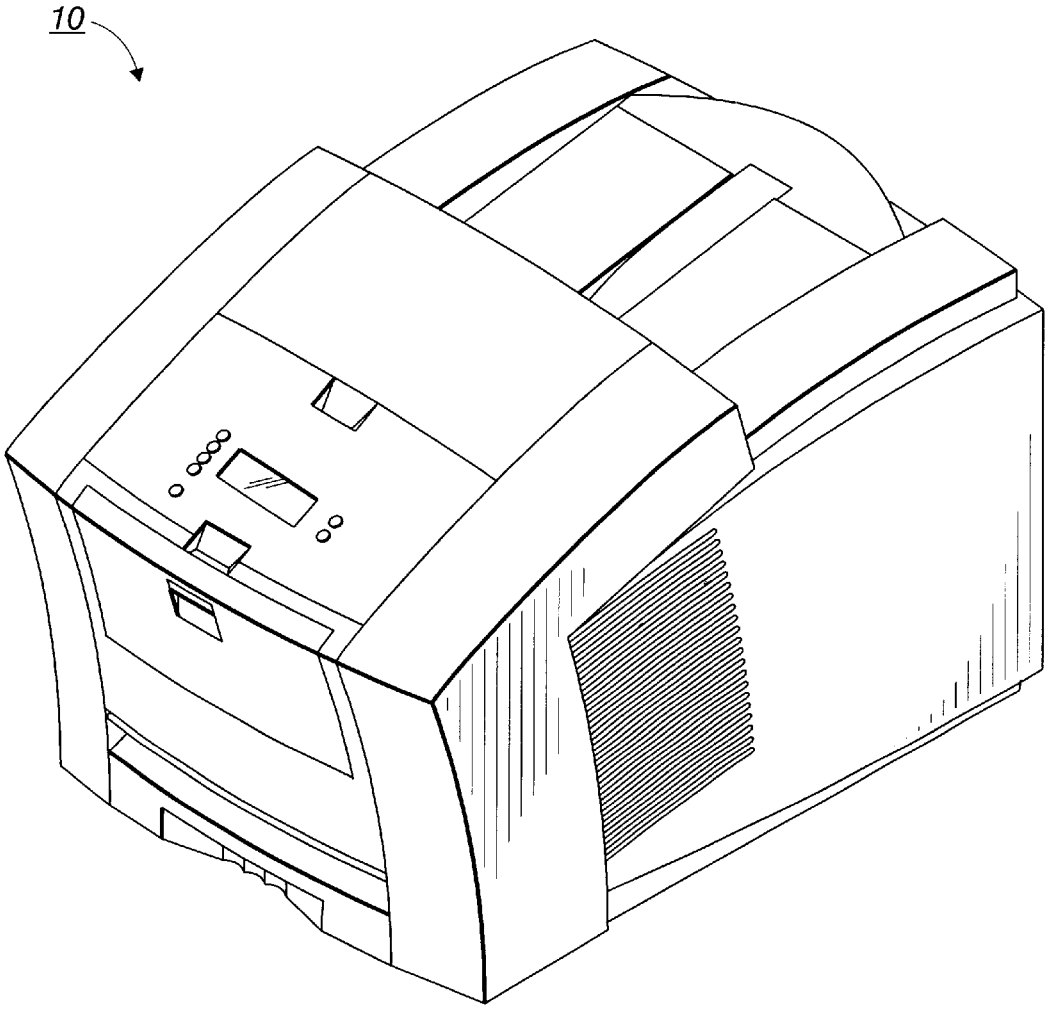
FIG. 1 is an overall perspective view of a color ink jet printer that uses the print head of the present invention.

FIG. 1 is an overall perspective view of a phase change ink jet printing apparatus, generally indicated by the reference numeral 10, that utilizes the print head of the present invention. It will be appreciated that the present invention may be used with various other ink jet printers that utilize other types of ink, such as aqueous ink. Accordingly, the following description will be regarded as merely illustrative of one embodiment of the present invention.

Figure 2:
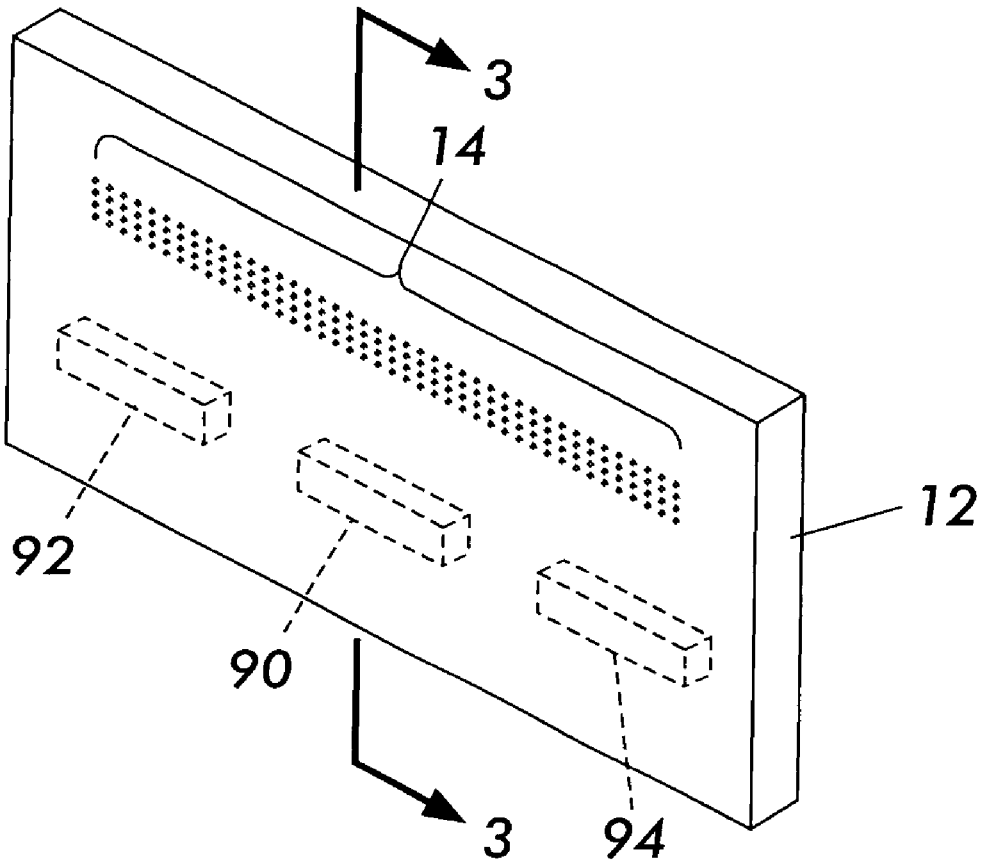
FIG. 2 is a simplified schematic illustration of an ink jet print head jet stack with enclosed vibration disruption chambers.

FIG. 2 is a simplified schematic view of one embodiment of an ink jet print head jet stack 12 that incorporates the present invention. The jet stack 12 includes an array of nozzles 14 for use in ejecting ink drops onto a receiving medium (not shown). The receiving medium may comprise a sheet of media for direct printing or an intermediate transfer surface, such as a liquid layer on a drum, for indirect or offset printing. As explained in more detail below, the jet stack 12 also includes vibration disruption chambers 90, 92, 94 positioned below the orifices 14.

The jet stack 12 is preferably formed of multiple laminated sheets or plates, such as stainless steel plates. The plates are stacked in face-to-face registration with one another and then brazed together to form a mechanically unitary and operational jet stack 12. An example of this type of jet stack is disclosed in U.S. Pat. No. 5,781,212 to Burr et al. entitled PURGEABLE MULTIPLE-ORIFICE DROP-ON-DEMAND INK JET PRINT HEAD HAVING IMPROVED JETTING PERFORMANCE AND METHODS OF OPERATING IT. U.S. Pat. No. 5,781,212 is hereby incorporated by reference in its entirety.

Figure 3:
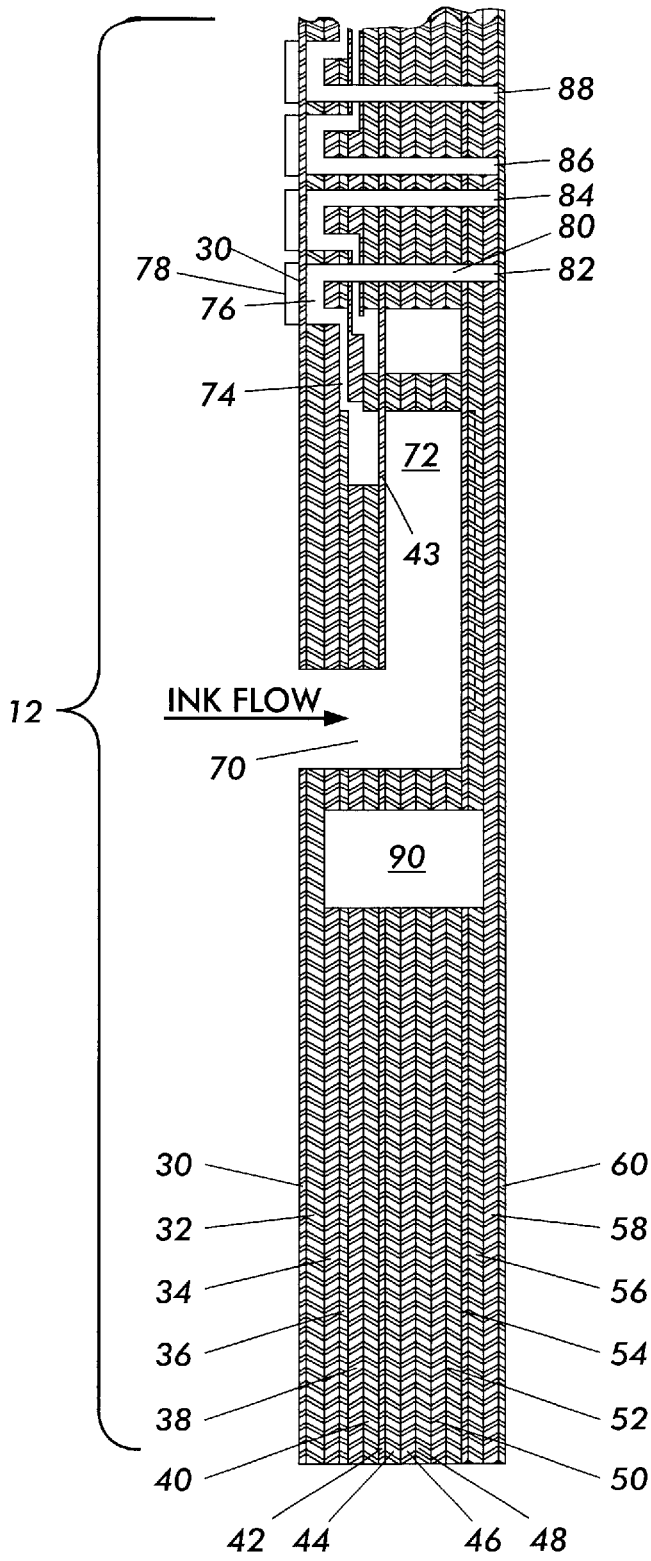
FIG. 3 is a diagrammatical cross-sectional view of the jet stack taken along the line 3—3 of FIG. 2 showing a first embodiment of the vibration disruption chambers of the present invention.

A cross-section of one embodiment of the jet stack 12 is illustrated in FIG. 3. This embodiment includes 16 plates: a diaphragm plate 30; a body plate 32; a first separator plate 34; an inlet plate 36; a second separator plate 38; a first manifold plate 40; a screen plate 42; a second manifold plate 44; a third manifold plate 46; a fourth manifold plate 48; a fifth manifold plate 50; an acoustic filter plate 52; a compliant wall plate 54; an acoustic filter half etch plate 56; an aperture brace plate 58; and an aperture plate 60. More or fewer plates than those illustrated may be used to define the various ink flow passageways, manifolds and pressure chambers of the jet stack.

The jet stack 12 receives liquid ink through a port area 70 from an adjacent ink reservoir (not shown). The ink flows through the port 70 and is collected in a manifold 72. From the manifold 72 the ink travels through a screen 43, along an inlet 74 and into a pressure chamber 76. The pressure chamber 76 is bounded on one side by a flexible diaphragm 30. An electromechanical transducer 78, such as a piezoelectric ceramic transducer, is secured to the diaphragm 30 by an appropriate adhesive and overlays the pressure chamber 76. The transducer mechanism 78 can comprise a ceramic transducer bonded with epoxy to the diaphragm plate 30. The transducer may be substantially rectangular in shape or, alternatively, may be substantially circular or disc-shaped. In a conventional manner, the transducer mechanism 78 has metal film layers to which an electronic transducer driver (not shown) is electrically connected.

The transducer 78 described with the preferred embodiment is a bending-mode transducer. When a voltage is applied across the metal film layers of the transducer 78, the transducer attempts to change its dimensions. Because it is securely and rigidly attached to the diaphragm 30, the transducer 78 bends and deforms the diaphragm, thereby displacing ink in the pressure chamber 76 and causing the outward flow of ink through outlet channel 80 to the nozzle 82. Refill of ink pressure chamber 76 following the ejection of an ink drop is accomplished by reverse bending of the transducer 78 and the resulting movement of the diaphragm 30. It will be appreciated that other types and forms of transducers may also be used, such as shear-mode, annular constrictive, electrostrictive, eletromagnetic or magnetostrictive transducers.

It will also be appreciated that various numbers and combinations of plates may be utilized to form the jet stack 12 and its individual components and features. Table 1 below shows representative dimensions for the plates comprising the jet stack 12 shown in FIG. 3:

TABLE 1

Thickness of Plates Shown in FIG. 3

| Plate | (mm) | (inches) |
|---|---|---|
| 30 | 0.08 | 0.003 |
| 32 | 0.2 | 0.008 |
| 34 | 0.2 | 0.008 |
| 36 | 0.1 | 0.004 |
| 38 | 0.2 | 0.008 |
| 40 | 0.2 | 0.008 |
| 42 | 0.05 | 0.002 |
| 44 | 0.2 | 0.008 |
| 46 | 0.2 | 0.008 |
| 48 | 0.2 | 0.008 |
| 50 | 0.2 | 0.008 |
| 52 | 0.2 | 0.008 |
| 54 | 0.05 | 0.002 |
| 56 | 0.2 | 0.008 |
| 58 | 0.2 | 0.008 |
| 60 | 0.05 | 0.002 |

Skilled persons will appreciate that other thicknesses and other relations of thicknesses may be used.

Figure 4:
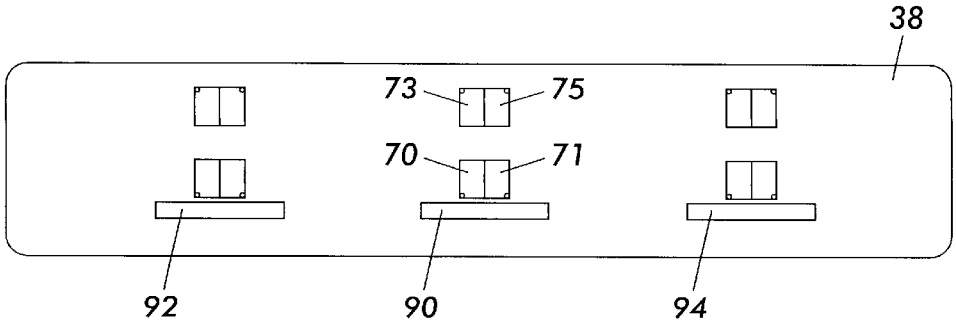
FIG. 4 is an enlarged and simplified schematic view of a separator plate from the jet stack of FIG. 3.

The jet stack 12 preferably defines four separate fluid pathways: one for black, and one for each of the subtractive primary colors cyan, yellow and magenta. Each fluid pathway utilizes one or more separate ports to receive the appropriate color ink from an ink reservoir. For example, FIG. 4 is a simplified front view of the second separator plate 38 from the jet stack 12, showing only those openings for ports and adjacent vibration disruption chambers for clarity. With reference also to FIG. 3, port 70 may receive black ink from an ink reservoir for delivery to the nozzle 82. The other three nozzles 84, 86 and 88 receive yellow, cyan and magenta ink, respectively, from separate ports 71, 73 and 75. The four separate fluid pathways have essentially identical structure downstream from their ports. Accordingly, for simplification, FIG. 3 illustrates only the pathway for black ink.

Multiple ports for a single color ink may be utilized across the width of the jet stack. For example, FIG. 4 illustrates an embodiment in which three separate ports are utilized for each of the four colors of ink across the width of the jet stack.

Figure 5:
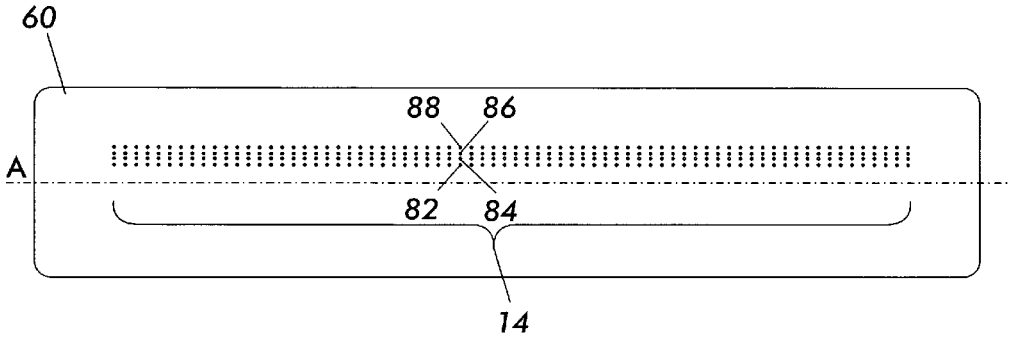
FIG. 5 is a front view of an aperture plate containing an array of ink jet apertures.

FIG. 5 is a simplified front view of one embodiment of the aperture plate 60 in the jet stack 12 showing the array 14 of nozzles extending across the width of the aperture plate. In this embodiment, 112 nozzles are provided for each of the four colors, yielding a total of 448 nozzles in the jet stack 12. As illustrated in FIG. 3, each nozzle has an associated pressure chamber and transducer.

In these types of jet stack designs utilizing multiple, closely spaced jets, a global or large-scale mechanical resonance may be created within the jet stack when a large number of jets are fired at a particular frequency. This mechanical resonance can have the undesirable effect of slowing the actuation of the transducers, which results in a drop in efficiency for the associated jet. As more transducers are actuated at the particular frequency, the magnitude of the resonance increases and the affected jets become slower and more inefficient.

To address this problem, and in an important aspect of the present invention, one or more vibration disruption chambers are provided in the jet stack to dampen mechanical vibrations within the jet stack. With regard to the multiple port jet stack layout illustrated in FIG. 4, the jets nearest to the ports may be more significantly affected by these global vibrations. Therefore, in one embodiment of the invention shown in FIG. 3, a single vibration disruption chamber 90 is provided adjacent to the port region 70 in the jet stack 12. With reference to FIG. 4, where multiple ports are provided for each color, a vibration disruption chamber may be provided for each port region. Alternatively, a single vibration disruption chamber may extend substantially the full-width of the jet stack 12.

Advantageously, each vibration disruption chamber alters the bending modes in the jet stack that are created by firing multiple transducers at various frequencies. Alternatively expressed, the vibration disruption chambers change the frequency and magnitude of different jet stack bending modes to move them away from a desired operating frequency. In this manner, the jet stack may be operated at the desired frequency without experiencing excessive bending or vibration in sensitive areas, such as the transducer and pressure chamber regions. The vibration disruption chambers may contain a vacuum or may be filled with a discontinuous material that augments the damping and other effects of the chambers. Examples of a discontinuous material include air, viscous fluids, elastomers, foams and the like.

Figure 6:
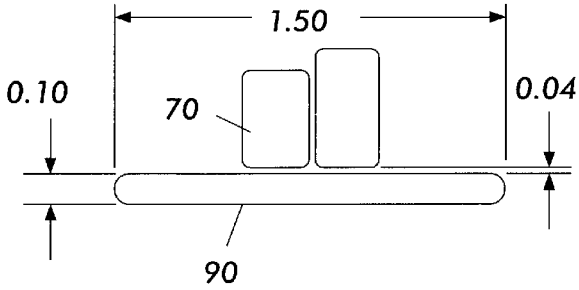
FIG. 6 is an enlarged schematic illustration showing the dimensions of a vibration disruption chamber and its position relative to a port in the print head.

FIG. 6 shows the dimensions of one embodiment of a vibration disruption chamber 90 of the present invention. In this embodiment, the vibration disruption chamber go has a length of about 1.5 in. (38.1 mm), a height of about 0.10 in.(2.5 mm) and is spaced below port 70 by about 0.04 in. (1.0 mm). As shown in FIG. 3, the vibration disruption chamber 90 is formed by contiguous openings in plates 34–56. It will be appreciated that the dimensions and positioning of the vibration disruption chambers 90, 92 and 94 may be adjusted to address the particular mechanical characteristics of a jet stack structure. For example, vibration disruption chamber 90 may be vertically spaced a greater distance from the port region 70.

In an alternative embodiment shown in FIG. 7, three component vibration disruption chambers 100, 102, 104 are incorporated below the port region 70. This embodiment simplifies the manufacturing of the jet stack 12, as openings in plates 40, 44, 46, 48 and 50 for a vibration disruption chamber are not required. A first or front vibration disruption chamber 100 is formed by contiguous openings in the acoustic filter plate 52, compliant wall plate 54 and acoustic filter half etch plate 56. The vibration disruption chamber opening in the acoustic filter plate 52 is vertically spaced from a second opening in the acoustic filter plate that defines a portion of the manifold 72.

A second or rear vibration disruption chamber 102 is formed by contiguous openings in the separator 1 plate 34, the inlet plate 36 and the separator 2 plate 38. The vibration disruption chamber opening in the inlet plate 36 is vertically spaced from a second opening in the inlet plate 36 that defines a portion of the port 70. Both the front and rear vibration disruption chambers 100, 102 may have a length, height and spacing from the port region 70 as shown in FIG. 6. With these dimensions and the plate thicknesses given in Table 1, both the front and rear vibration disruption chambers 100, 102 may have a preferred volume of about 0.0027 in.$^3$ (44.23 mm$^3$). It will be appreciated that the dimensions of the vibration disruption chambers may be varied to suit a particular jet stack design. For example, the volume of the front and rear vibration disruption chambers 100, 102 may range between about 0.001 in.$^3$ (16.39 mm$^3$) and about 0.060 in.$^3$ (983.6 mm$^3$).

Figure 7:
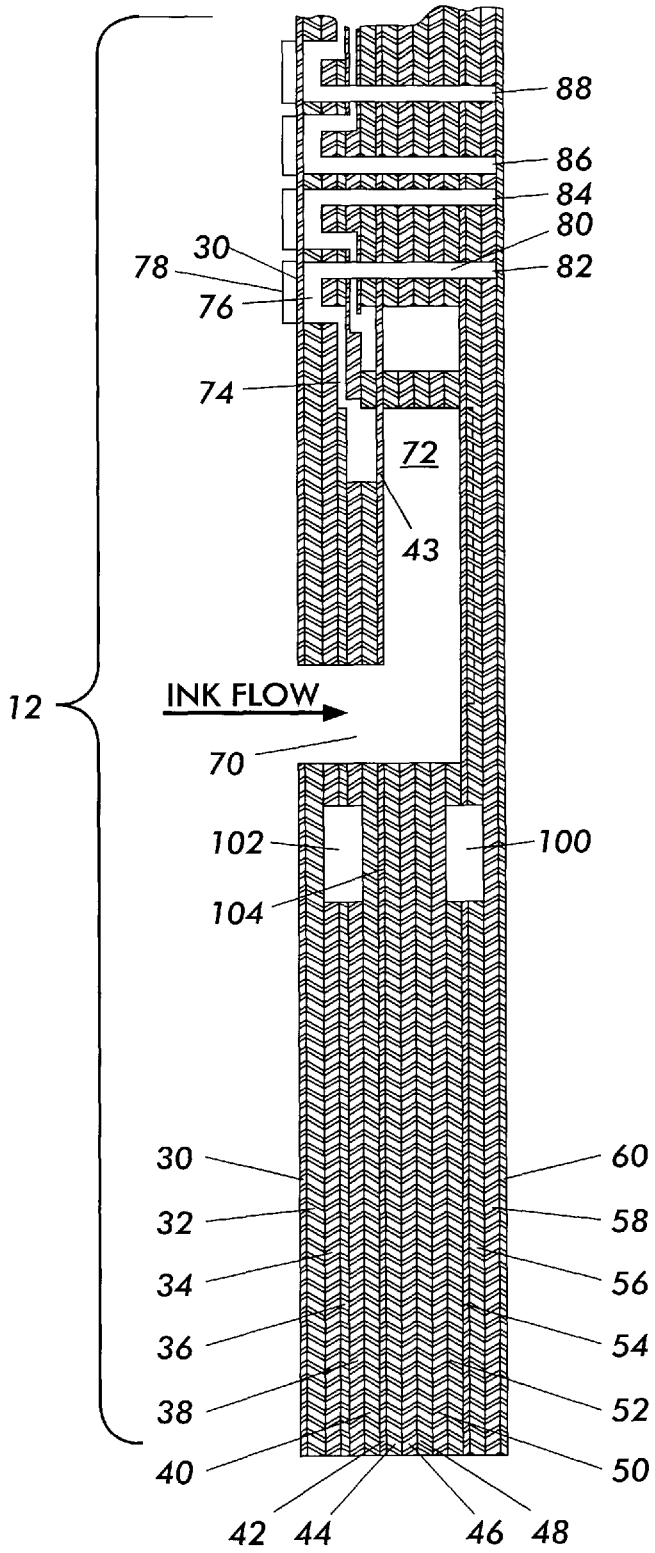
FIG. 7 is a cross-sectional view of a jet stack showing a second embodiment of the vibration disruption chambers of the present invention.

With continued reference to FIG. 7, a third or middle vibration disruption chamber 104 may also be provided between the front vibration disruption chamber 100 and the rear vibration disruption chamber 102. In the illustrated embodiment, the middle vibration disruption chamber 104 is formed by an opening in the screen plate 42. The middle vibration disruption chamber 104 may also have a length, width and spacing from the port region 70 as shown in FIG. 6. The volume of the middle chamber 104 may be between about 0.0001 in. (1.639 mm$^3$) and about 0.0036 in.$^3$ (59.01 mm$^3$), and more preferably about 0.0003 in.$^3$ (4.918 mm$^3$).

The preferred embodiment was chosen and described to provide the best illustration of the principles of the invention and its practical application to thereby enable one of ordinary skill in the art to utilize the invention in various embodiments and with various modifications as is suited to the particular use contemplated. All such modifications and variations are within the scope of the invention as determined by the appended claims when the claims are interpreted in accordance with breadth to which they are fairly, legally, and equitably entitled. All patents cited herein are incorporated by reference in their entirety.

What is claimed is:

1. An ink jet print head having a plurality of plates bonded together, the plurality of plates including a first plate and a second plate spaced from the first plate, the print head comprising:

a nozzle in the first plate for ejecting ink onto a receiving surface;

a manifold between the first plate and the second plate, the manifold being fluidically coupled to the nozzle;

a vibration disruption chamber vertically spaced from the manifold for reducing mechanical vibrations within the printhead, wherein the vibration disruption chamber includes a first vibration disruption chamber and a second vibration disruption chamber horizontally spaced from the first vibration disruption chamber, wherein at least one of the plurality of plates is between the first vibration disruption chamber and the second vibration disruption chamber;

an ink flow path from the manifold to the nozzle;

a pressure chamber located along the ink flow path between the manifold and the nozzle; and a transducer coupled to the pressure chamber, the transducer being driven to eject ink through the nozzle.

2. The ink jet print head of claim 1, further including a third vibration disruption chamber between the first vibration disruption chamber and the second vibration disruption chamber.

3. The ink jet print head of claim 1, wherein the vibration disruption chamber contains a discontinuous material.

4. An ink jet print head having a plurality of plates bonded together, the plurality of plates including a first plate and a second plate spaced from the first plate, the print head comprising:

a nozzle in the first plate for ejecting ink onto a receiving surface;

a third plate positioned between the first plate and the second plate, the third plate including a first opening that defines a portion of a manifold, the manifold being fluidically coupled to the nozzle;

the third plate including a second opening vertically spaced from the first opening, the second opening defining at least a portion of a vibration disruption chamber that reduces mechanical vibrations within the print head;

a fourth plate that is bonded to the third plate, the fourth plate including an opening contiguous with the second opening in the third plate to further define the vibration disruption chamber;

an ink flow path from the manifold to the nozzle;

a pressure chamber located along the ink flow path between the manifold and the nozzle; and a transducer coupled to the pressure chamber, the transducer being driven to eject ink through the nozzle.

5. The ink jet print head of claim 4, further including a fifth plate bonded to the fourth plate and positioned between the fourth plate and the first plate, the fifth plate including an opening contiguous with the opening in the fourth plate to further define the vibration disruption chamber.

6. The ink jet print head of claim 5, wherein the vibration disruption chamber has a volume of between about 0.001 in.$^3$ and about 0.060 in.$^3$.

7. The ink jet print head of claim 4, wherein the vibration disruption chamber contains a discontinuous material.

8. The ink jet print head of claim 4, wherein the vibration disruption chamber is a front vibration disruption chamber, and further including a rear vibration disruption chamber between the front vibration disruption chamber and the second plate.

9. The ink jet print head of claim 8, further including a sixth plate between the front vibration disruption chamber and the second plate, the sixth plate including a first opening that forms a port that is fluidically coupled to the manifold for supplying ink to the manifold, the sixth plate including a second opening vertically spaced from the first opening, the second opening defining at least a portion of the rear vibration disruption chamber.

10. The ink jet print head of claim 9, further including a seventh plate that is bonded to the sixth plate, the seventh plate including an opening contiguous with the second opening in the sixth plate to further define the rear vibration disruption chamber.

11. The ink jet print head of claim 10, further including an eighth plate bonded to the sixth plate, the eighth plate including an opening contiguous with the second opening in the sixth plate to further define the rear vibration disruption chamber.

12. The ink jet print head of claim 11, wherein the rear vibration disruption chamber has a volume of between about 0.001 in.$^3$ and about 0.060 in.$^3$.

13. The ink jet print head of claim 8, wherein the front vibration disruption chamber and the rear vibration disruption chamber contain a discontinuous material.

14. The ink jet print head of claim 8, further including a middle vibration disruption chamber between the front vibration disruption chamber and the rear vibration disruption chamber.

15. The ink jet print head of claim 14, further including a ninth plate between the sixth plate and the third plate, the ninth plate including an opening that forms the middle vibration disruption chamber.

16. The ink jet print head of claim 15, wherein the middle vibration disruption chamber has a volume of between about 0.0001 in.$^3$ and 0.0036 in.$^3$.

17. The ink jet print head of claim 14, wherein the front vibration disruption chamber, the middle vibration disruption chamber and the rear vibration disruption chamber contain a discontinuous material.

* * * * *